US010850313B2

(12) United States Patent
Bruegger et al.

(10) Patent No.: US 10,850,313 B2
(45) Date of Patent: Dec. 1, 2020

(54) TUNNEL CLEANING DEVICE

(71) Applicant: Brügger HTB GmbH, Frutigen (CH)

(72) Inventors: Beat Bruegger, Frutigen (CH); Matthias Bruegger, Frutigen (CH); Thomas Bruegger, Frutigen (CH)

(73) Assignee: BRÜGGER HTB GMBH, Frutigen (CH)

( * ) Notice: Subject to any disclaimer, the term of this patent is extended or adjusted under 35 U.S.C. 154(b) by 129 days.

(21) Appl. No.: 16/013,319

(22) Filed: Jun. 20, 2018

(65) Prior Publication Data

US 2018/0369884 A1 Dec. 27, 2018

(30) Foreign Application Priority Data

Jun. 21, 2017 (EP) ..... 17177161

(51) Int. Cl.

| | |
|---|---|
| ***B08B 9/049*** | (2006.01) |
| ***B08B 5/02*** | (2006.01) |
| ***B08B 9/035*** | (2006.01) |
| ***B08B 1/00*** | (2006.01) |
| ***B08B 7/04*** | (2006.01) |
| ***B61D 15/00*** | (2006.01) |

(Continued)

(52) U.S. Cl.

CPC ..... *B08B 9/049* (2013.01); *B08B 1/002* (2013.01); *B08B 5/02* (2013.01); *B08B 7/04* (2013.01); *B08B 9/035* (2013.01); *B61D 15/00* (2013.01); *E01B 27/102* (2013.01); *E01B 31/02* (2013.01); *E01H 1/005* (2013.01); *E01H 1/0872* (2013.01); *B05B 1/005* (2013.01); *B05B 14/30* (2018.02)

(58) Field of Classification Search

CPC ..... B08B 9/049; B08B 1/002; B08B 5/02; B08B 14/30; B61D 5/00; E01B 27/102; E01B 31/02; E01B 1/005; E01B 1/0872; B05B 14/30; B05B 14/005; B05B 1/05

See application file for complete search history.

(56) References Cited

U.S. PATENT DOCUMENTS

| | | | | |
|---|---|---|---|---|
| 2,932,845 | A | 4/1960 | Rydberg | |
| 4,168,562 | A * | 9/1979 | Maasberg | E01H 1/103 15/320 |

(Continued)

FOREIGN PATENT DOCUMENTS

| | | |
|---|---|---|
| DE | 1 100 063 B | 2/1961 |
| EP | 0 887 470 A1 | 12/1998 |

(Continued)

*Primary Examiner* — Dung Van Nguyen

(74) *Attorney, Agent, or Firm* — Birch, Stewart, Kolasch & Birch, LLP

(57) ABSTRACT

The invention relates to a cleaning device for the dry cleaning of a tunnel, comprising a feeding device for feeding a flow of air to a surface being cleaned, wherein the feeding device has an exit opening, through which the flow of air emerges from the feeding device, and a removal device comprising at least one removal pipe with a free end with an opening for suctioning away direct or trash from the surface with the opening of the free end in a first direction. The feeding device is arranged such that the flow of air from the exit opening emerges from the feeding device in a second direction toward the opening of the free end of the removal pipe and impinges on the surface. The first direction is oriented at an angle between 45° and 80° to the second direction.

19 Claims, 7 Drawing Sheets

(51) Int. Cl.

| | |
|---|---|
| ***E01B 31/02*** | (2006.01) |
| ***E01B 27/10*** | (2006.01) |
| ***E01H 1/08*** | (2006.01) |
| ***E01H 1/00*** | (2006.01) |
| *B05B 14/30* | (2018.01) |
| *B05B 1/00* | (2006.01) |

(56) References Cited

U.S. PATENT DOCUMENTS

| | | | | |
|---|---|---|---|---|
| 5,457,847 | A * | 10/1995 | Uzawa | B08B 5/026 15/345 |
| 7,017,226 | B2 * | 3/2006 | Ikeda | B08B 1/04 15/308 |
| 9,409,215 | B2 * | 8/2016 | Sun | B08B 5/02 |
| 2013/0276838 | A1 | 10/2013 | Brock | |

FOREIGN PATENT DOCUMENTS

| | | | |
|---|---|---|---|
| EP | 2 653 614 | A2 | 10/2013 |
| FR | 2 999 196 | A1 | 6/2014 |

* cited by examiner

TUNNEL CLEANING DEVICE

FIELD OF TECHNOLOGY

The invention relates to a cleaning device for the dry cleaning of a tunnel, comprising a feeding device for feeding a flow of air to a surface being cleaned, wherein the feeding device has an exit opening, through which the flow of air emerges from the feeding device. The cleaning device further comprises a removal device comprising at least one removal pipe with a free end with an opening for suctioning away dirt or trash from the surface with the free end in a first direction.

PRIOR ART

For a friction-free ride, the roadways of road and rail vehicles must be maintained regularly. This also includes the cleaning of the roadways. In the case of rail vehicles, the maintenance of the roadways also includes for example the regular grinding of the rails in order to prevent material fatigue due to flaws in the running surface. Such work produces a lot of fine dust and dirt, which becomes deposited in the rail bed and in the shoulder of the roadway.

Especially in tunnels, dirt and particularly fine dust on the roadway, on the tunnel walls and on the tunnel ceiling may impair the electronics of passing vehicles or even cause failures of the electronics. It is therefore especially important to clear the roadway and other surfaces of dust and trash at regular intervals in tunnels, where the dust cannot escape.

Various cleaning principles are known for this from the prior art. Thus, for example, a wet cleaning may be done. For this, the cleaning vehicle comprises a cleaning head which can be positioned above the roadway. Such a cleaning head comprises water nozzles, which generate a water jet directed at the surface being cleaned. Dirt and water are sucked up by a suction shoe and taken to a dirt container on the cleaning vehicle.

Another kind of cleaning is dry cleaning. The cleaning is done here not with a liquid, but instead with air. This has the advantage that the installations in the tunnel are treated in a mechanically gentle way, and corrosion damage due to the moisture applied is avoided.

Cleaning devices for such a dry cleaning of railway tunnels are marketed for example by the firm Hilton Kommunal GmbH, Gehrden (Germany). One such cleaning device mounted on a rail vehicle comprises several arms standing off from the rail vehicle and pointing toward the tunnel walls. A suction shoe is arranged at the respective outer ends of the arms, in order to suck up dirt from the tunnel walls and the tunnel ceiling. The arms are adjustable in length, so that obstacles on the walls and ceiling can be avoided during the movement, in that the arms are retracted toward the vehicle.

The rail vehicle furthermore comprises another cleaning unit for cleaning the gravel next to the rails. For this, a suction pipe with a rectangular suction shoe can be lowered onto the gravel next to the rails. Furthermore, the surface being cleaned is blown with compressed air.

Another cleaning device is described by EP 0 887 470 A1 (Schorling-Brock GmbH). This discloses a rail vehicle with a device for cleaning the grooves in the rails. The device comprises a suction shoe, which is moved at a slight distance above the rails. In the travel direction, close to the rear end of the suction shoe, there is located a rotating brush in order to loosen the hard dirt situated in the grooves. The rotating direction of the brush is opposite the travel direction, so that the dirt loosened by the brush is thrown in the direction of the suction shoe. Moreover, a nozzle is located in front of the suction shoe, looking in the travel direction, which can generate a cleaning flow directed against the bottom of the groove in the form of a mixture of compressed air and water. The brush and the nozzle are adjustable in the direction perpendicular to the groove. In this way, the brush and the nozzle can be lifted when cleaning track switches.

Such known cleaning devices have a suction shoe with a relatively large cross sectional area, covering half or even the entire width of the railway track with the two rails. In this way, dirt can be sucked in over a relatively large area in a single pass. However, such known suction shoes are not very efficient. If a thorough cleaning is desired, that is, suctioning up as much dust as possible and especially also dust lying deep in the gravel or in the subgrade, a very high suction power of several thousand kilowatts is required. A suction blower providing such a power generates a lot of heat. However, the development of a lot of heat in a tunnel is a problem. It leads to a danger of fire, can cause damage to the infrastructure in the tunnel, and worsens the working conditions for workers and service personnel in the tunnel.

PRESENTATION OF THE INVENTION

The problem which the invention proposes to solve is to create a cleaning device belonging to the above indicated field of technology which enables an efficient and at the same time thorough cleaning of a tunnel.

The solution of the problem is defined by the features of claim 1. According to the invention, the feeding device is arranged such that the flow of air from the exit opening emerges from the feeding device in a second direction toward the opening of the free end of the removal pipe and impinges on the surface, the first direction being oriented at an angle between 45° and 80° to the second direction, especially at an angle between 60° and 70° to the second direction.

Since the dirt or the trash is not only loosened from the surface by the supplied flow of air, as in known cleaning devices, but also the flow of air is inclined toward the suction direction, an especially large amount of dirt and trash can be loosened and then sucked up. This enables an efficient cleaning of the tunnel. It was discovered during the development of the cleaning device that an angle between 45° and 80° is especially advantageous in this case. That is, the dirt loosened from the surface or the to dirt lying free on the surface is blown substantially toward the opening of the free end of the removal pipe. This prevents the dirt swirled up or loosened by the flow of air from being taken into an area next to the removal pipe that is no longer reached by the removal pipe and therefore cannot be sucked up by the free end of the removal pipe. In this way, an especially thorough cleaning of the surface is made possible with the arrangement of the feeding device relative to the free end of the removal pipe according to the invention.

In addition, it has been found during the cleaning of railways with gravel bed that the action of an air jet in the mentioned direction, even at large suction power, prevents gravel from being sucked up. No significant rearrangements of gravel due to the influence of air have been found with the device according to the invention.

By dry cleaning is meant in the present specification a cleaning with air or another gas, but substantially without the use of a liquid. This means that no liquid, but rather a gas, is used for the loosening of the dirt from the surface, unlike wet cleaning. This statement pertains to the loosening and gathering of dirt and trash. Even if a liquid is afterwards supplied to the collected dirt and trash in a later step, it is still a dry cleaning as long as basically no liquid is applied to the surface being cleaned.

The term "surface" encompasses not only the uppermost layer, but also areas lying immediately below the uppermost layer. Thus, for example, in the case of a loose subgrade, such as a gravel or shingle bed, a lower lying layer in the gravel or shingle bed situated at a distance from an uppermost layer is also covered by the term "surface".

The terms "dirt" and "trash" encompass all substances not belonging to the roadway infrastructure and not designed to remain in the area of the roadway. This includes, for example, dust, rust, lubricants, defective parts, articles of clothing, foods, packaging materials such as beverage bottles and plastic bags, plants, pests and insects.

The removal pipe can basically have any desired cross section. Thus, for example, the removal pipe may have a round circular, an oval, a rectangular or a polygonal cross section. The feeding device preferably comprises a feed pipe. This may also have any desired cross section, such as a round circular, an oval, a rectangular or a polygonal cross section, for example.

According to the invention, dirt or trash is sucked up from the surface by the free end of the removal pipe in a first direction. The first direction basically corresponds to a longitudinal axis of the removal pipe in the area of the free end of the removal pipe.

Furthermore, according to the invention, the flow of air emerges from the exit opening in a second direction toward the opening of the free end of the removal pipe from the feeding device and onto the surface. The second direction is thus defined by the points lying in the spatial center of the air jet which is situated between the exit opening and the surface. The expression "toward the opening of the free end of the removal pipe" means that a first distance between the center of the exit opening and the center of the cross sectional area of the opening in the free end of the removal pipe is greater than a second distance between the central point of incidence of the air jet on the surface and the center of the cross sectional area of the opening in the free end of the removal pipe. Thus, the air jet runs in the direction toward the opening of the free end of the removal pipe. The claimed angle between the first direction and the second direction corresponds to the smallest angle between these two directions.

Preferably the feeding device is designed to be arranged adjacent to the removal pipe. In this way, the air jet can be brought especially close to the removal pipe. The dirt and dust loosened and swirled up by the air jet can therefore be sucked up especially well by the removal pipe.

Preferably the distance between the center of the cross sectional area of the exit opening of the feeding device and the center of the cross sectional area of the opening of the free end of the removal pipe is smaller than 0.5 m, preferably smaller than 0.3 m. In this way, the feeding device and the removal device are arranged close together. This enables an especially close guidance of the flow of air at the opening of the free end of the removal pipe, making possible an especially efficient suctioning and therefore an especially thorough cleaning of the surface.

Preferably the removal pipe is arranged such that it can be moved as close as possible onto the surface. Furthermore, the feeding device is preferably arranged so that it can be moved as close as possible onto the surface.

Preferably the cleaning device is designed to clean a roadway and a region next to the roadway as well as the tunnel walls and possibly also the tunnel ceiling. In one preferred embodiment, the cleaning device comprises several cleaning units, preferably at least one for the roadway, at least one for the floor next to the roadway, and at least one for the tunnel walls. These cleaning units or at least one or more of them comprise a feeding device and a removal device according to claim 1.

Preferably the removal device comprises several removal pipes for the suctioning, preferably at least 10 removal pipes per meter, especially preferably at least 20 removal pipes per meter. In this way, the suction surface for the suctioning of dirt and trash can be enlarged, while a high suction power per pipe is assured. This enables an efficient cleaning of the surface.

Preferably the removal pipes are arranged in a row alongside each other. Preferably the removal pipes are arranged alongside each other, so that the removal pipes rest against each other and mutually touch each other. With this arrangement, an especially efficient cleaning of the surface can be achieved. If the cleaning device is mounted on a vehicle, the removal pipes are preferably arranged in a direction transversely to the travel direction of the vehicle, next to each other in a row. Alternatively, the removal pipes have a mutual spacing from each other preferably not greater than 10 cm, especially preferably not greater than 5 cm.

Preferably the removal pipe comprises an end element at an end of the removal pipe directed toward the surface being cleaned, wherein the end element is movable relative to the feeding device. Preferably the opening for suctioning of dirt or trash is situated at the free end of the end element. The end element in this case may be mounted for example pivotably, movable in linear manner, and/or rotatable with respect to the feeding device.

Thanks to the adjustable end element, the opening may be positioned relative to the surface being cleaned such that as much dirt and trash as possible can be sucked up. Furthermore, the end element may also be positioned optimally to the feeding device, so that the dirt loosened and swirled up by the flow of air can be sucked up as efficiently as possible through the opening in the end element.

Preferably the end element is made of a rigid material such as sheet metal or the like. In this way, the opening at the free end preserves its shape, so that a reliable suctioning of the dirt from the surface is made possible.

Alternatively, it is also possible for the removal pipe to not have any end element and for the removal pipe to be fastened immovably with respect to the feeding device.

Advantageously, the end element of a first removal pipe of the several removal pipes is movable relative to an end element of a second removal pipe of the several removal pipes. This means that all removal pipes are individually movable and adjustable. In this way, the cleaning device can be attuned precisely to the surface being cleaned. Thus, for example, several individual removal pipes may be lifted or positioned at an angle to the surface in order to be able to achieve a better cleaning. Moreover, thanks to this adjustability, it is also possible to suction out recesses and depressions in the surface being cleaned by positioning one or more individual removal pipes in the depression. In this way, an efficient and thorough cleaning can be achieved even for an irregular surface.

Preferably each end element is movable independently of the other end elements. This allows for a greatest possible flexibility in the adjusting of the removal pipes.

Preferably the end elements of a cleaning device are movable in the vertical direction for a substantially horizontal surface, such as a rail bed or a shoulder. In this way, the free ends of the end elements can be easily positioned with respect to the surface being cleaned.

Preferably the maximum adjustability of a first end element with respect to a second end element is at least 20 cm, preferably between 25 cm and 30 cm, in the vertical direction. With such an adjustability, the cleaning device can be adapted optimally to obstacles or depressions in the surface.

Alternatively, the possibility also exists that the removal pipes are arranged immovably, or only all removal pipes can be moved together.

Preferably the removal pipe has an inner diameter between 5 and 30 cm, preferably an inner diameter between 8 and 20 cm. Such a diameter enables a sufficiently large suction surface, and yet a flexible use of the removal pipe. Thus, the removal pipe is small enough to be able to be lowered for example between rails in a track switch or into a depression. In this way, corners or narrow regions can also be cleaned thoroughly. Nevertheless, an efficient suctioning is made possible with this size of the inner diameter, since the cross section of the removal pipe is thus also large enough to suck up not only dust, but also larger objects such as packagings or plastic beverage bottles.

Preferably the removal pipe has a flexible region after the end element in the suction direction and a rigid region adjoining the flexible region, so that the end element can swivel relative to the rigid region of the removal pipe. In this way, the opening at the free end of the end element can be easily positioned relative to the surface. Furthermore, the flexible region makes it possible to briefly move the end element out from its position, for example by an obstacle, when the removal pipes are being moved along the surface during the cleaning. In this way, one can avoid damaging the end elements of the removal pipes, and a good cleaning result can be achieved even without active control by adjusting a slight distance between the removal pipes and the surface being cleaned and moving the removal pipes away when necessary by the mechanical contact between the end elements and the surface being cleaned. In this case, it is advantageous to make the end elements of a sturdy material, so that they are not damaged by the mechanical contact.

Alternatively—especially when the removal pipes are actively movable—the possibility also exists of making them entirely of a rigid material.

Preferably the feeding device comprises several feed pipes for the feeding of the flow of air. In this way, the flow of air can be supplied in easy manner to the surface being cleaned.

Preferably a first feed pipe is arranged on a first side next to the removal pipe and a second feed pipe is arranged on a second side of the removal pipe opposite the first side. In this way, the dirt or dust may be blown from two sides toward the removal pipe. If the cleaning device is moved relative to the surface and the feed pipes are arranged in the direction of movement in front of and behind the removal pipe, the dirt can first be loosened from the surface by a first flow of air from a first feed pipe and then the remaining dirt can be grasped by the second flow of air from the second feed pipe and be blown toward the removal pipe. This enables an especially thorough cleaning.

In an arrangement on a vehicle, the first side is situated next to the removal device, at which the first feed pipe is arranged, behind the removal pipe looking in the travel direction of the vehicle, while the second side of the removal device, opposite the first side, at which the second feed pipe is arranged, lies in front of the removal pipe in the travel direction.

Preferably a third feed pipe is arranged on a third side next to the removal pipe and a fourth feed pipe is arranged on a fourth side, opposite the third side. In this way, the dirt can be blown from four sides toward the removal pipe. Thus, the area of the surface handled by the cleaning device is enlarged.

In an arrangement on a vehicle, the third and fourth side each lie transversely to the travel direction of the rail vehicle with respect to the removal pipe.

In one alternative embodiment, the feeding device may also have only one feed pipe. The feeding device may also have no feed pipe at all. In this case, the flow of air is taken directly from an air pressure source through an exit opening onto the surface.

Preferably a brush is arranged in an end region of the removal pipe, for brushing off the surface being cleaned. The end region of the removal pipe is in this case the region of the removal pipe facing toward the surface being cleaned. Because the surface is brushed off prior to the suctioning, even particularly stubborn dirt can be loosened from the surface. The loosened dirt can then be blown by the supplied flow of air toward the removal pipe. Thanks to the use of a brush, an especially efficient cleaning may therefore occur even for a heavily soiled surface.

In a first variant, the brush is a roller brush. The roller brush preferably comprises a rigid core and elastic bristles arranged around the core. The use of a roller brush enables a simple brushing off of the surface, especially when the cleaning device is mounted on a vehicle and the removal pipes are moved along the surface.

In a second variant, the brush comprises a plurality of bristles, which are arranged stationary on the removal pipe and surround the opening of the removal pipe for example on at least 3 sides (i.e., at an angle of around) 270°. In this way, on the one hand, the dust can be mechanically loosened from the surface in front in the travel direction, and on the other hand there is produced a flexible boundary for the air channel to the removal pipe.

Preferably the cleaning device according to the invention is part of a cleaning module which furthermore comprises a compressed air source for generating an air pressure in the feeding device, a suction device for generating a partial vacuum in the removal device, and a container to hold the suctioned dirt and trash.

Advantageously, the compressed air source generates an air pressure in the feeding device of at least 400,000 Pa (4 bar), preferably at least 550,000 Pa (5.5 bar).

Preferably the volume flow for the feeding device generated by the compressed air source is between 2000 $m^3/h$ and 8000 $m^3/h$. The effective overall volume flow at the exit openings of the feeding device will be somewhat lower on account of the effect of the feed lines.

Preferably the suction power generated for the removal device by the suction device is between 20,000 $m^3/h$ and 60,000 $m^3/h$. The effective overall suction power at the removal pipes of the removal device will be somewhat lower on account of filters and other elements.

In one preferred embodiment, the cleaning module comprises a chamber formed by four side walls and a cover, wherein at least one lower end region of the removal device and a lower end region of the feeding device are enclosed by the chamber, wherein a pressure can be generated in the chamber which is less than atmospheric pressure. The chamber need not be hermetically sealed, but only make possible the generating of a suitable partial vacuum with the aid of a suitable suction device. Values of a partial vacuum of 40,000 Pa or more can be advantageously achieved in such a chamber.

The chamber for example may be formed by an encircling side wall with flexible aprons and a cover. Accordingly, "enclosed by the chamber" means that an element is situated in the space which is bounded by the four side walls, the cover, and the surface being cleaned. With the aid of the chamber, it can be ensured that the dirt loosened and optionally swirled up in the effective area of the chamber is not transported into other areas.

It has been discovered, in the context of the device according to the invention and with the use of the chamber, that powers on the order of 700-1000 kW are sufficient to obtain a good cleaning result. Thus, the heat generation is kept within bounds.

In another preferred embodiment, the cleaning module comprises a detection device for detecting obstacles, an evaluation unit and a drive for adjusting the removal device in the vertical direction relative to the feeding device. The detection device is designed to send signals to the evaluation unit and the evaluation unit is designed to control the drive in dependence on the signals. Preferably, the drive enables the adjustment of individual removal pipes (or small groups of such removal pipes) of the removal device, so that a lifting can occur only immediately in the area of an obstacle, while the suctioning continues unchanged in other areas. Besides the removal device, the feeding device may also be controlled in dependence on the signals of the detection device.

The detection device may be based on various principles and several detection principles may be combined with each other. These include optical detection by means of cameras, ultrasound sensors, radar sensors, inductive sensors, etc. Mechanical sensors with probes are also conceivable, as are force sensors which determine actions on the probes.

The cleaning module according to the invention is used in particular on a rail vehicle. The cleaning module and the cleaning device, respectively, are especially well suited to the cleaning of railway tunnels, namely the rails, the rail bed, the shoulder and the tunnel wall, in the dry cleaning method.

Advantageously, the rail vehicle comprises at least four wheels each with a running surface, wherein the free end of the removal pipe can be lowered past the lowermost point on the running surface of a wheel by at least 15 cm, preferably at least 30 cm, in the vertical direction, so that the free end is positioned just above the surface being cleaned. This allows a thorough cleaning of the rail bed between the rails and outside the rails.

Accordingly, the feeding device is preferably arranged and designed such that the free end of the feeding device can be lowered up to 10 cm, preferably up to 5 cm toward a subgrade on which the rail of the rail vehicle is resting.

In one preferred embodiment, the feeding device and the removal pipes can move relative to the vehicle in the transverse direction to the travel direction of the vehicle. This makes possible an adapting to the geometry of the bearing surface being cleaned. An adapting in the transverse direction may be needed especially when different tracks of a multiple-track tunnel are being cleaned.

In this context, it may be advantageous for a width of the surface being cleaned to be adjustable. For this, for example, the removal pipes and/or the feed pipes are divided into two or more groups, which can move individually in the transverse direction. In a non-overlapping arrangement, the working range is at maximum, while it is reduced in the case of an arrangement overlapping in the transverse direction.

The invention further relates to a method for the dry cleaning of a tunnel with a cleaning device according to the invention, where the method involves the following steps:

- positioning of the cleaning device relative to the surface being cleaned,
- moving the cleaning device relative to the surface along a longitudinal axis of the tunnel,
- during the movement, feeding a flow of air onto the surface, so that dirt or trash is loosened from the surface,
- during the movement, removing the loosened dirt or trash from the surface with a removal device.

Advantageously, at least one removal pipe of several removal pipes of the removal device is moved during the cleaning of the tunnel in a direction relative to the surface and relative to another one of the removal pipes which is different from the longitudinal axis of the tunnel. The movement can be done by a direct mechanical interaction between the removal pipe (especially an end element of the removal pipe) and elements of the installation being cleaned, and/or be actively controlled with the aid of sensor data.

Further advantageous embodiments and combinations of features of the invention will emerge from the following detailed specification and the totality of the patent claims.

BRIEF DESCRIPTION OF THE DRAWINGS

The drawings used to explain the sample embodiment show.

Basically, the same parts are provided with the same reference numbers in the figures.

WAYS OF IMPLEMENTING THE INVENTION

Figure 1A:
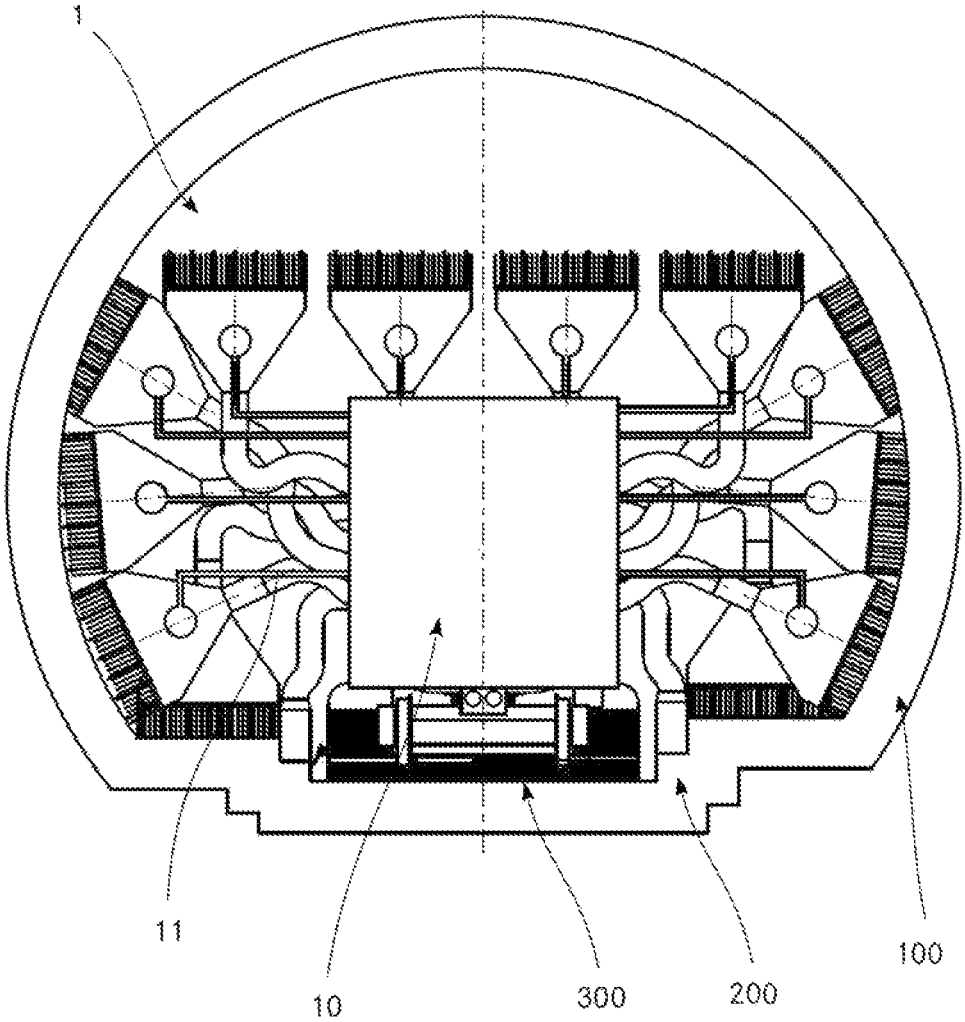
FIG. 1A a view of a cross section through a railroad tunnel, in which a rail vehicle according to the invention is situated with a cleaning module according to the invention, FIG. 1B a side view of the rail vehicle with the cleaning unit for the rail bed, FIG. 2A a schematic representation of the cleaning unit for the tunnel wall, FIG. 2B a side view of the cleaning unit for the tunnel wall, FIG. 2C a diagonal view of the cleaning unit for the tunnel wall, FIG. 2D a diagonal view of a further embodiment of the cleaning unit for the tunnel wall, FIG. 2E a side view of the further embodiment of the cleaning unit for the tunnel wall, FIG. 3 a schematic representation of the cleaning unit for the shoulder, FIG. 4 a schematic representation of the cleaning unit for the rail bed, FIG. 5 a perspective representation of the cleaning unit for the rail bed on the rail vehicle, FIG. 6 a detail view of an area of the cleaning unit for the rail bed, FIG. 7 a view of the cleaning unit for the rail bed with lowered and extended chamber in the cleaning position, and FIG. 8 a view of the cleaning unit transversely to the travel direction.

FIG. 1A shows a view of a cross section through a railroad tunnel, in which a rail vehicle 10 according to the invention is situated. The rail vehicle 10 is shown from the rear.

Figure 1B:
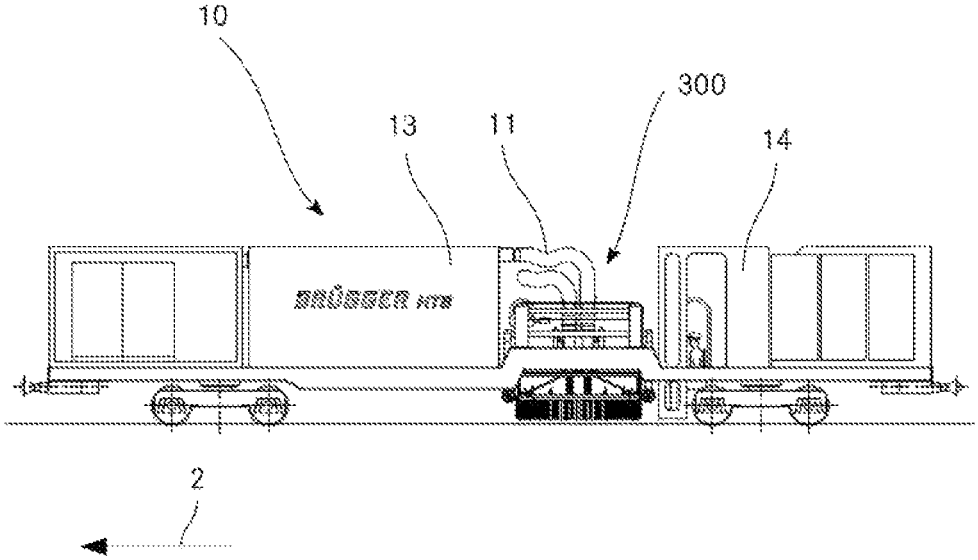

The rail vehicle 10 comprises several cars. On one car is arranged a cleaning module 1 according to the invention. This comprises a cleaning device having a tunnel wall cleaning unit 100, a shoulder cleaning unit 200 and a rail bed cleaning unit 300. The cleaning devices each comprise a feeding device for feeding a flow of air to the surface being cleaned and a removal device with removal pipes for sucking up dirt and trash from the surface in the tunnel. Moreover, the cleaning module 1 comprises a blower for generating a partial vacuum in the removal pipes, a compressor for generating an air pressure in feed lines of the feeding devices of the cleaning units 100, 200, 300 as well as a dirt container 13 for catching and collecting the suctioned dirt and trash, as can be seen in FIG. 1B. For this, the cleaning units 100, 200, 300 are connected by means of flexible pipelines 11 to the dirt container 13. On the same car there is furthermore arranged a driver's position 14. A user can steer the cleaning units 100, 200, 300 here. The rail vehicle 10 further comprises a flatbed car, on which further dirt containers 13 are placed, which can be swapped out for the dirt container 13 which is connected to the cleaning devices 100, 200, 300. Other cars of the rail vehicle 10 contain passenger cabins or cargo space.

In FIG. 1B one can see the car of the rail vehicle 10 on which the cleaning unit 300 is arranged. In this representation, one notices that the dirt container 13 is arranged on the car in front of the cleaning unit 300 for the rail bed, looking in the travel direction 2. The driver's position 14 is located on the car behind the cleaning unit 300, looking in the travel direction 2.

For the cleaning of the railroad tunnel, the cleaning units 100, 200, 300 are positioned with respect to a surface being cleaned 20 in the tunnel and the blower and the compressor are switched on. After this, the rail vehicle 10 moves through the tunnel at a walking pace, the cleaning units 100, 200, 300 being moved along the inner tunnel surfaces.

Figure 2A:
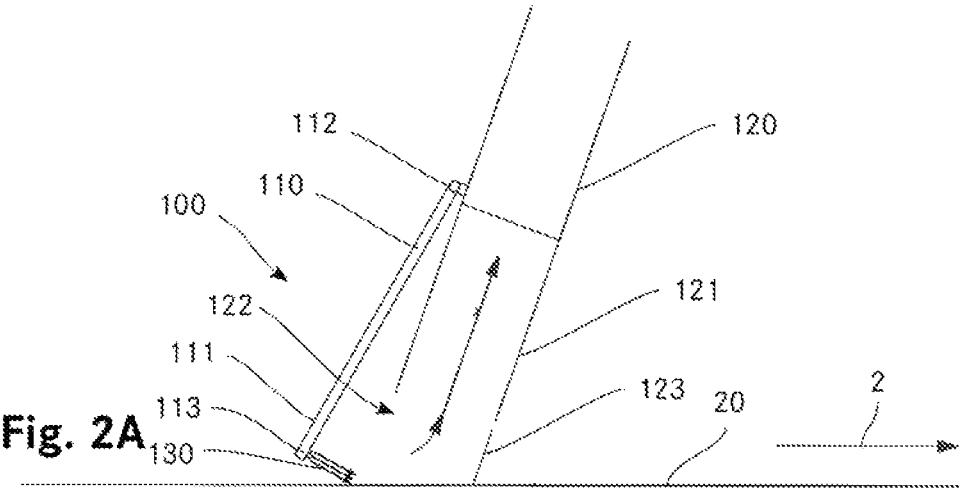
Figure 2B:
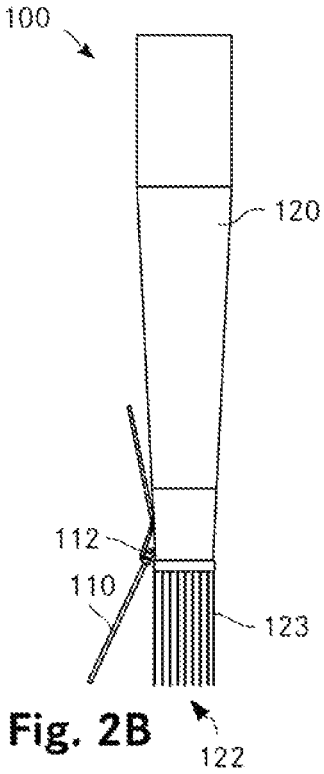
Figure 2C:
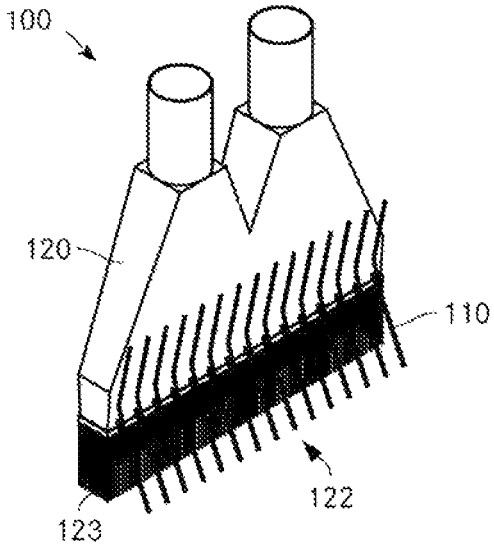
Figure 2D:
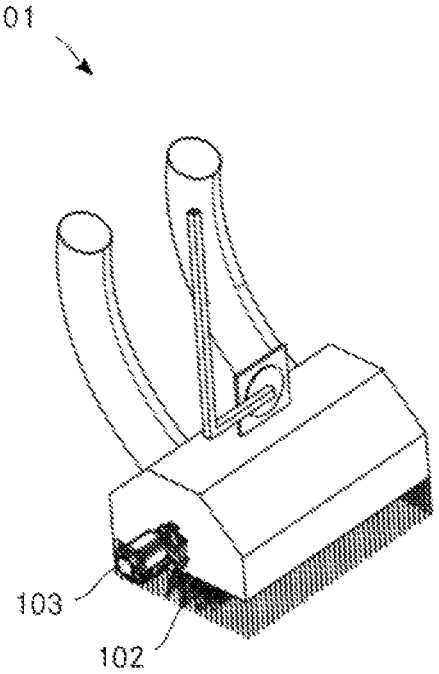
Figure 2E:
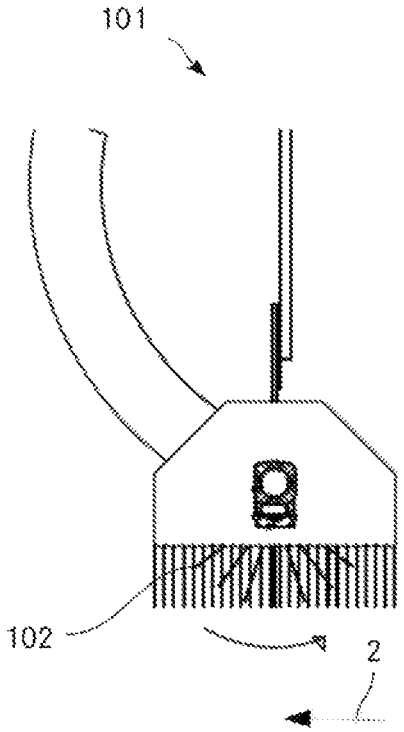
Figure 3:
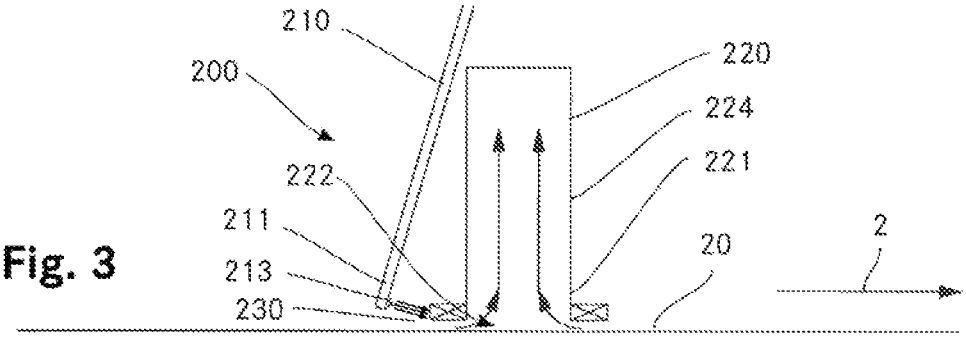
Figure 4:
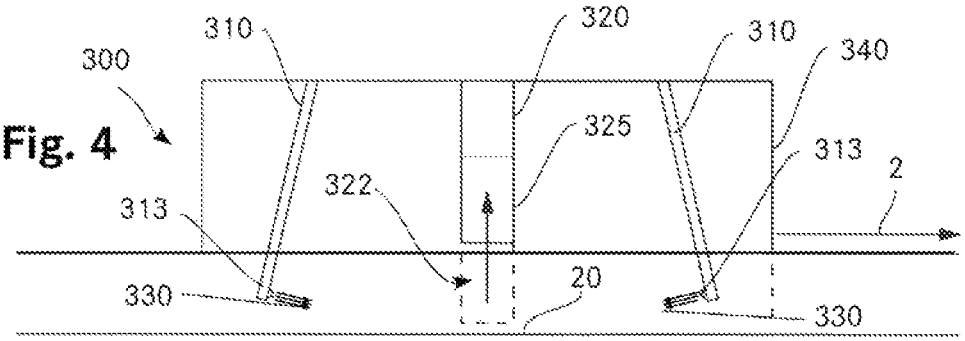

FIGS. 2 to 4 each show a schematic representation of the three cleaning units 100, 200, 300 for the tunnel wall, for the shoulder and for the rail bed. The function of these cleaning units shall be described in detail hereafter.

FIG. 2A shows schematically the cleaning unit 100 for the tunnel wall. FIG. 2B shows a side view, and FIG. 2C a diagonal view of the cleaning unit 100 for the tunnel wall.

The travel direction 2 of a vehicle carrying this cleaning unit 100 is indicated by an arrow. As is evident from FIG. 2, this cleaning unit 100 for the tunnel wall comprises a feeding device in the form of feed pipes 110 to for supplying a flow of air 130 to the surface being cleaned. At a free end 111, pointing toward the surface, each feed pipe 110 has a nozzle 113, through which a flow of air emerges from the feed pipe 110 and is guided onto the surface 20 being cleaned. The cleaning unit 100 furthermore comprises a removal device with a removal pipe 120 for taking away the dirt or trash from the surface. The removal pipe has a suction mouth 122 at its free end 121 directed toward the surface. Moreover, a brush 123 surrounding the suction mouth 122 is arranged at this free end 121 of the removal pipe 120, which brushes off the surface being cleaned 20 during the operation of the cleaning unit 100 and borders the suction channel at least partly in the travel direction 2. The feed pipe 110 is mounted by a joint 112 in the region of the free end of the removal pipe 121 so as to be able to swivel, so that the free end of the feed pipe 111 can be swiveled relative to the free end of the removal pipe 121.

Preferably, the suction mouth 122 of the removal pipe 120 is substantially rectangular or oblong oval in configuration and has several feed pipes 110 at a rear long side, in the travel direction 2, so that several flows of air 130 can be directed onto the surface 20 being cleaned per each removal pipe 120. The suction mouth 122 is connected by the removal pipe, which is designed as a flexible removal pipeline, to the dirt container 13 and the blower on the rail vehicle 10. The dirt and trash sucked up is thus sucked through the suction mouth 122 and arrives in the dirt container 13 through the removal pipeline.

The cleaning module 1 comprises a holding device with drive unit (not shown) for the cleaning unit 100 for the tunnel wall. By means of the holding device, the removal pipe 120 and the feed pipes 110 of the tunnel wall cleaning unit are held on the rail vehicle 10. The holding device comprises a telescopic arm, which is mounted at an inner end on the rail vehicle 10 and carries at its outer end the free end of the removal pipe 121 and the feed pipes 110 mounted on the removal pipe. In this way, the free end of the removal pipe 121 can be moved with respect to the rail vehicle 10. Thus, the free end of the removal pipe 121 with the suction mouth 122 can be moved transversely to the travel direction of the rail vehicle 10 away from the rail vehicle 10 or toward the rail vehicle. Furthermore, the free end of the removal pipe 121 can be swiveled about a rotational axis. Thanks to this adjustability, the cleaning unit 100 can be oriented precisely toward the tunnel wall or toward the tunnel ceiling, so that the brush 123 touches the surface 20. This adjustment occurs by means of the drive unit of the holding device. For this, the drive unit comprises one electric motor each for extension and retraction of the telescopic arm and for swiveling of the free end of the removal pipe 121. The electric motors can be controlled by the operator at the driver's position 14 of the rail vehicle 10 or by an automatic control system.

For the cleaning of the tunnel, the cleaning unit 100 for the tunnel wall is taken up to the surface 20 of the tunnel wall or the tunnel ceiling, so that the brush 123 touches the surface 20 of the tunnel. Since the brush 123 comprises flexible bristles, small obstacles such as cable ducts and signs can be driven over with the brush 123, without having to move the cleaning unit 100 away from the surface 20. As the feed pipes 110 are mounted movably on the removal pipe 120, they are briefly pushed away from the surface 20 when driving over obstacles and in this way suffer no damage.

Since the brush 123 which is arranged at the free end of the removal pipe 121 is arranged partly in front of the suction mouth 122 of the removal pipe 120, looking in the travel direction 2, it first brushes off this surface 20 being cleaned, before the suction mouth 122 sucks up the dust and the loosened dirt particles. In order for the dust and loosened dirt to be sucked in by the removal pipe 120, the blower of the cleaning module on the rail vehicle 10 generates a partial vacuum, so that a suction flow is created at the free end of the removal pipe 121. The suction power of the blower in this case is around 90,000 $m^3/h$ in total.

The flow of air 130 conducted in the feed pipes 110 is under a pressure of around 6000 Pa. This pressure is generated by the compressor on the rail vehicle 10. The flow of air 130 emerges through the nozzle 113 of the feed pipe 110 and impinges on the surface 20 being cleaned in the direction of the suction mouth 122 of the removal pipe 120. In this way, on the one hand the dirt is loosened from the surface 20 and on the other hand it is blown in the direction of the suction mouth 122. In this process, the longitudinal axis of an end region of the feed pipe 110 stands at an acute angle to the longitudinal axis of an end region of the removal pipe 120. By orienting the end region of the removal pipe 120, the dust and the dirt are sucked up from the surface in a first direction. The flow of air 130 emerging from the exit opening of the feed pipe 110 is directed toward the suction mouth 122 of the free end of the removal pipe 121 and impinges on the surface in a second direction. The first direction is oriented at an angle between 45° and 80° to the second direction.

In FIGS. 2D and 2E, a further embodiment of the cleaning unit 101 for the tunnel wall is represented. By contrast with the above described embodiment, this cleaning unit 101 has a rotating brush roller 102. The brush roller 102 is driven by an electric motor 103, which is arranged on a housing of the brush roller 102. As can be seen in FIG. 2E, the brush roller 102 rotates in a direction contrary to the travel direction 2 of the rail vehicle 10. In this way, even dirt very strongly attached to the surface can be loosened from the surface of the tunnel wall or tunnel ceiling.

FIG. 3 represents schematically the cleaning unit 200 for the rail shoulder. This comprises a feeding device in the form of a feed pipe 210 and a removal device in the form of a removal pipe 220, having a suction opening 222 at its free end 221. In the area of a free end 211, the feed pipe 210 is connected immovably to the free end 221 of the removal pipe 220 (not represented). During operation, the longitudinal axis of the end region of the removal pipe 220 is oriented substantially at right angles to the surface 20 of the tunnel. The supplied flow of air 230 emerges in the front region of the feed pipe 210 through a nozzle 213 and impinges on the surface 20 being cleaned in the direction of the suction opening 222 of the removal pipe 220. The feed pipe 210 is located behind the removal pipe 220, looking in the travel direction, wherein the emerging flow of air 230 is conducted in the travel direction 2 toward the surface 20.

The angle between the direction in which the flow of air 230 impinges on the surface and the direction in which the dirt is sucked up by the removal pipe 220 lies in the range of 45° to 80°.

As described above for the cleaning unit 100 for the tunnel wall, the dirt in the shoulder is loosened by the supplied flow of air 230 and sucked up with the suction opening 222 of the removal pipe 220. The suction opening 222 has a round circular cross section, preferably with an inner diameter between 20 cm and 40 cm. The removal pipe 220 has, in the area of its free end 221, an end section 224 made of a stiff material, such as steel sheeting. This end section 224 is conical in configuration (not represented in FIG. 3) and is connected by a flexible removal pipeline to the dirt container 13 and the blower on the rail vehicle 10. The end section 224 is secured by means of two chains to a structure on the rail vehicle 10 such that the end section 224 and thus the suction opening 222 and the free end of the feed pipe 211 can be moved in the vertical direction with respect to the shoulder.

FIG. 4 shows schematically the cleaning unit 300 for the rail bed. This has several feed pipes 310 and several removal pipes 320. The feed pipes 310 are arranged, looking in the travel direction, in front of and behind the removal pipes 320, and also transversely to the travel direction at the side of the removal pipes 320, as can be seen from FIGS. 5 and 6.

The removal pipes 320 are arranged in two rows alongside each other transversely to the travel direction. In the sample embodiment shown, the cleaning unit 300 for the rail bed comprises two groups of 15 removal pipes 320 each in the form of removal pipe units 350.1, 350.2. This arrangement of the removal pipes 320 can be seen in FIGS. 5 and 7 and is described in detail below.

Each removal pipe 320 has an inner diameter of 10 cm, the outer diameter being slightly larger. This produces a maximum width covered by the removal pipes 320 of over 4 m. Furthermore, each removal pipe 320 has an end element 325 in the area of its free end, which is formed from a stiff material, such as steel sheeting. The end element 325 has a circular round cross section and forms a suction mouth 322 for sucking up the dirt and trash from the surface. Looking in the suction direction, a flexible section 326 is arranged behind the end element 325, comprising a bellows, making possible a lengthwise contraction (cf. FIGS. 5-7). The flexible sections 326 of several removal pipes 320 are joined by a hood 327. The hood 327 together with the removal pipes 320 forms a removal pipe unit 350.1, 350.2, which preferably comprises 10-15 removal pipes 320. The hood 327 of each removal pipe unit 350.1, 350.2 is connected by a main removal pipe 351 to the dirt container 13 and the blower on the rail vehicle 10.

Thanks to the flexible bellows section 326, the end elements 325 of the removal pipes 320 can be raised and lowered in the vertical direction with respect to the hood 327 by cable pulleys individually and independently of the other end elements 325. This adjustment is done by lifting or lowering an end element 325 by means of two cables, fastened to the end element 325, in the vertical direction. The cables may also be activated by the operator in the driver's position 14 in order to be able to move the end elements 325 during operation. In other embodiments, the end elements 325 may also be lifted or lowered by means of an electrical, hydraulic or pneumatic drive unit. An individual end element 325 can be lifted by a maximum of 30 cm relative to the other end elements 325. In this way, the end elements 325 can be lifted or lowered individually and independently of each other in the area of a track switch or an obstacle, in order to clean the subgrade in precise manner. Furthermore, the hood 327 together with the removal pipes 320 can be moved as a whole relative to the rail vehicle 10. This adjustment option shall be described in detail further below in connection with FIGS. 5 and 6.

The flexible section 326 moreover enables a swiveling of the respective removal pipe 320 if its end element 325 touches an obstacle.

As is indicated schematically in FIG. 4, the area of the free ends of the feed pipes 310, the end elements 325 and the flexible sections 326 of the removal pipes 320 are surrounded by a chamber 340. This comprises four side walls and a cover. In the chamber 340, a partial vacuum of around 40,000 Pa can be generated. The lower regions of the side walls of the chamber 340 are formed from elastic aprons. In this way, the entire chamber 340 with the cleaning unit 300 can be lowered onto the rail bed, so that the elastic aprons are pushed away by the rails in the area of the rails.

As with the cleaning unit 100 for the tunnel wall and the cleaning unit 200 for the shoulder, the feed pipes 310 of the cleaning unit 300 for the rail bed serve for loosening the dirt from the surface being cleaned with a flow of air 330. The loosened dirt is sucked up from the surface by the suction mouths 322 of the removal pipes 320 in a first direction. The flow of air 330 emerging from a nozzle 313 in the feed pipe 310 is directed toward the suction mouths 322 and impinges on the surface in a second direction. The first direction is oriented at an angle between 45° and 80° to the second direction.

Figure 5:
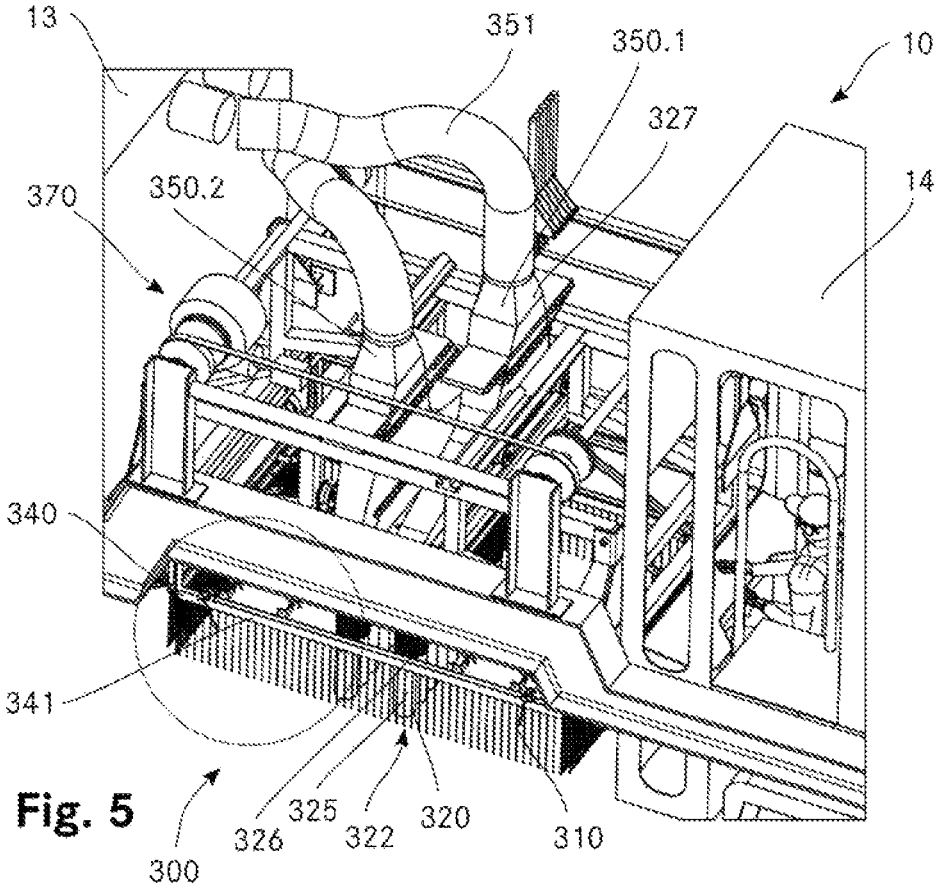

FIG. 5 shows a perspective view of the cleaning unit 300 for the rail bed according to the invention, mounted on the rail vehicle 10. A circle marks a feature which is shown enlarged in FIG. 6.

Furthermore, one can see in FIG. 5 the chamber 340 which is arranged on an underside of the rail vehicle 10 and which has a rectangular base area. The bordering edge of the chamber 340 comprises four vertically oriented side walls, which are formed by elastic aprons (cf. FIG. 6). These are arranged in two halves, which can be moved relative to one another in the horizontal direction, transversely to the travel direction. In this way, the base area or the volume of the chamber 340 can be altered. The aprons are fastened on a framelike linkage 341. At the top, the chamber is closed by a (transparent) cover.

In FIG. 5 it can be seen that the feed pipes 310 are arranged along the four side walls of the chamber 340. For simplicity, FIGS. 5-8 only represent the frontmost regions of the free ends of the feed pipes 310. The feed pipes 310 are fastened on the framelike linkage 341 and can swivel, so that they swivel away when they touch an obstacle. The respective outlets of the feed pipes 310 point toward the middle of the chamber 340 to the removal pipes 320 situated there. In this way, the dirt and dust during operation is blown by the flow of air 330 from the feed pipes 310 in the travel direction as well as transversely to the travel direction toward the suction mouths 322 of the removal pipes 320 in the chamber 340.

Furthermore, the two removal pipe units 350.1, 350.2 empty into the chamber 340. For this, the respective hood 327 of the removal pipe units 350.1, 350.2 is connected to the framelike linkage 341 of the chamber 340. Moreover, one can see in FIG. 5 the main removal pipes 351 which connect each of the removal pipe units 350.1, 350.1 to the dirt container 13.

As can be seen in FIG. 5, the cleaning unit 300 for the rail bed comprises an adjusting device 370 for adjusting the removal pipe units 350.1, 350.2 with respect to the rail vehicle 10. For this, the adjusting device 370 contains two transversely extending linear guides, along which the removal pipe units 350.1, 350.2 can be displaced transversely to the travel direction of the rail vehicle 10. The removal pipe units 350.1, 350.2 are displaced manually by hand or by means of an electric, hydraulic, or pneumatic drive unit. Thus, each removal pipe unit 350.1, 350.2 can be moved outward from the middle of the vehicle on one side. Here, the two halves of the chamber 340 are likewise moved to the outside with respect to one another. The removal pipe units 350.1, 3502 can be moved outward from the middle of the vehicle until the rows of removal pipes 320, looking in the travel direction, no longer overlap, so that all removal pipes 320 are arranged alongside each other, as can be seen in FIG. 7.

Moreover, the adjusting device 370 comprises hoists, with which the chamber 340 together with both removal pipe units 350.1, 350.2 can be raised or lowered in the vertical direction relative to the rail bed. In addition to this adjustment option, each removal pipe unit 350.1, 350.2 comprises the cable pulleys described above in connection with FIG. 4 so as to move the end elements 325 of the removal pipes 320 individually and independently of each other. The adjusting device 370 moreover comprises electric motors for operating the cable pulleys and for moving the removal pipe units 350.1, 350.2 along the guides. The electric motors may in this case be controlled by the operator from the driver's position 14. Moreover, the cable pulleys for the individual removal pipes 340 may also be operated from the driver's position 14. Alternatively, the end elements 325, as mentioned above, may also be raised or lowered by means of an electric, hydraulic or pneumatic drive unit.

Moreover, from the driver's position 14 the operator can also control the compressor for generating the air pressure in the feed pipes 110, 210, 310 and the blower for generating the suction power in the removal pipes 120, 220, 320. The compressor generates an air pressure of 600,000 Pa and achieves a volume flow of around 2100 $m^3$/h. The blower achieves a suction power of 90,000 $m^3$/h.

Figure 6:
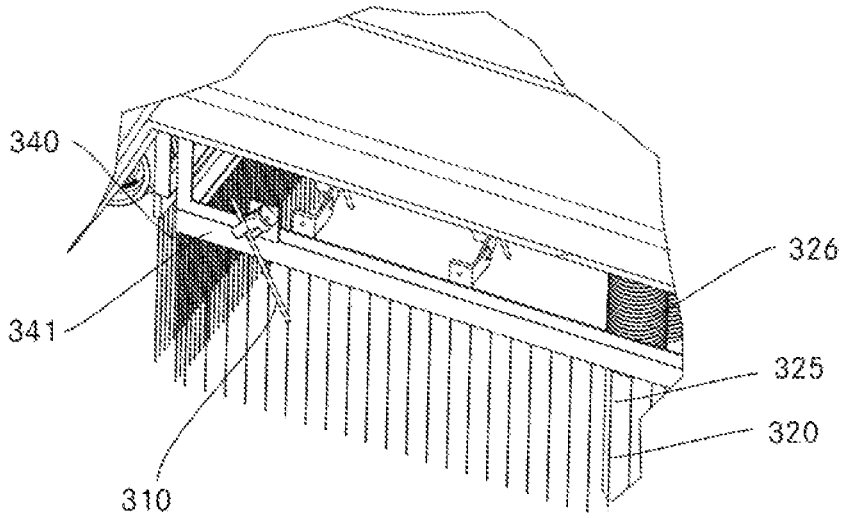
Figure 7:
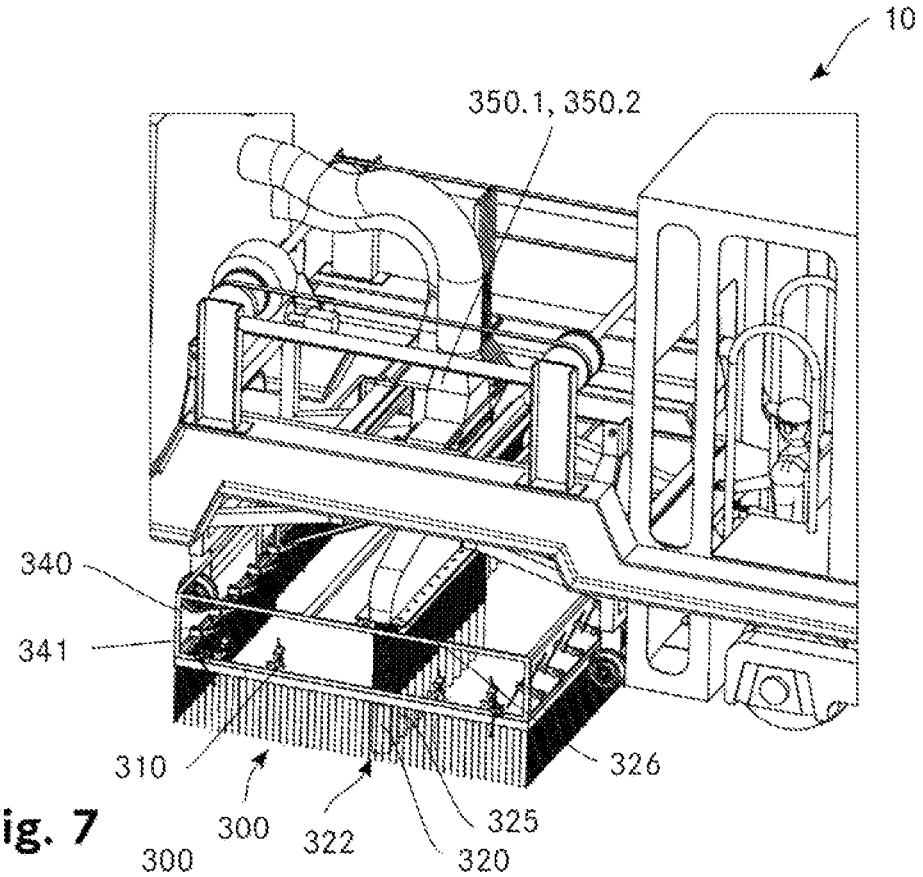

While FIG. 6 shows the position of the cleaning unit 300 for the rail bed in a ready position, in which the chamber 340 has been raised, FIG. 7 shows the position of the cleaning unit 300 for the rail bed during the cleaning of the rail bed, where the chamber 340 finds itself in a lowered cleaning position. In the cleaning position shown, the two halves of the chamber 340 have been moved apart from each other transversely to the travel direction and the two removal pipe units 350.1, 350.2 are likewise moved apart from each other transversely to the travel direction, so that the removal pipe units 350.1, 350.2 are arranged alongside each other and in this way the removal pipes 320 can cover a maximum width of the rail bed.

In the cleaning position, even small obstacles like signals or signs which stick out at most by 30 cm from the subgrade can be driven over without having to raise the chamber 340. Since the feed pipes 310 are mounted movably on the framelike linkage 341, they are briefly swiveled upward by the obstacle. The same thing occurs with the end elements 325 of the removal pipes 320. These can be pushed away by an obstacle, thanks to the flexible section 326, without suffering damage. They automatically return to their working position by virtue of gravity, once the obstacle has been driven over.

The cleaning unit 300 for the rail bed can be lowered so that the free ends of the feed pipes 310 and the removal pipes 320 are close to the gravel bed or the fixed bed of the rails, preferably up to 2 cm above it. Thanks to the described arrangement of the removal pipes 320 and the adjustment possibility of the individual end elements 325, the rail bed can also be cleaned thoroughly in the area of a track switch, since the end elements 325 of the removal pipes 320 can be individually raised or lowered in order to adjust the suctioning surface exactly to the subgrade.

The adjusting of the end elements 325 can be done manually. In another embodiment, however, the adjustment can also be automatic. For this, the cleaning module 300 has sensors arranged in front of the removal pipes 320 in the travel direction for detecting the rail bed and a control unit for evaluating the sensor signals and for controlling the adjusting device 370. In this embodiment, the subgrade is monitored by the sensors constantly when driving over the subgrade. If an obstacle is identified, the control unit moves the individual end elements 325 of the removal pipes 320. Thus, for example, individual end elements 325 are raised when the rail vehicle 10 is traveling over a track switch, or a larger obstacle stands in the way.

Figure 8:
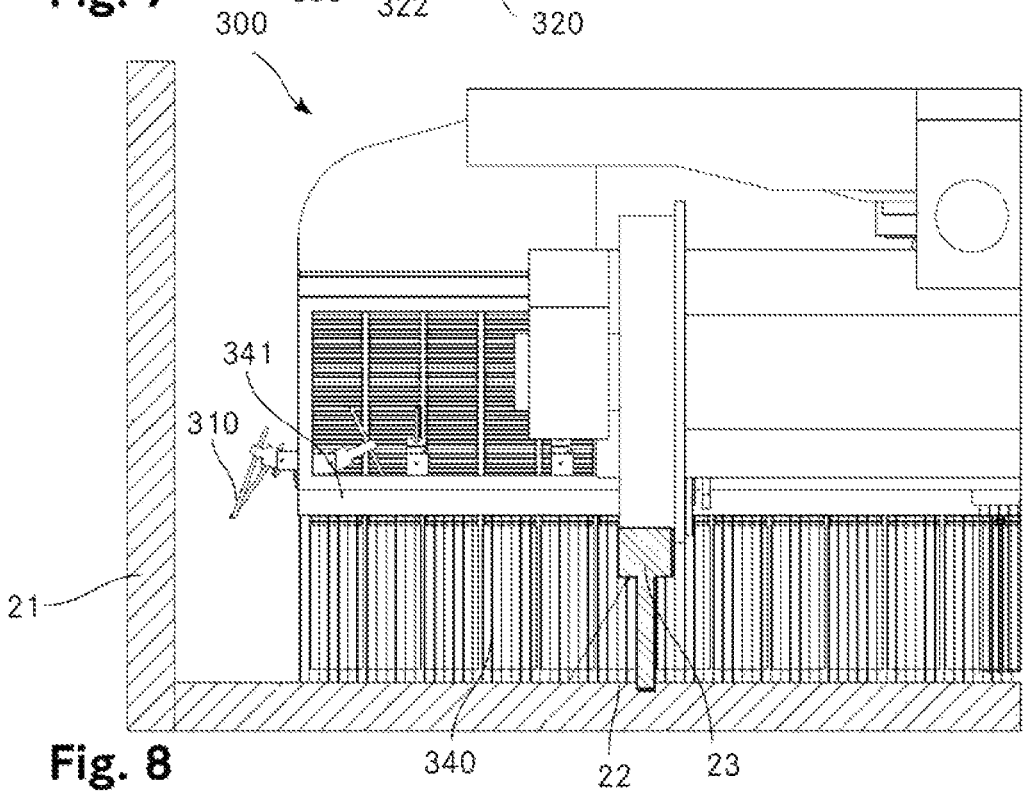

FIG. 8 shows a view of the cleaning unit 300 transversely to the travel direction. One can see in particular the feed pipes 310, which are arranged along the border of the chamber 340. Their mouths are positioned beneath a rolling plane defined by the rail head 23. The aprons, which form the side walls of the chamber 340, moreover reach almost down to the firm roadway 22, so that a partial vacuum can be built up inside the chamber 340 with a relatively low suction power. Some of the feed pipes 310 are arranged on the outside of the chamber 340 on a framelike linkage 341. Their mouth points toward the lowermost region of the tunnel wall 21. The compressed air put out by these feed pipes loosens dust and dirt in this area. Because of the partial vacuum in the chamber 340, this dust and dirt is also sucked into the chamber 340 and thus removed.

In summary, the cleaning device according to the invention enables an efficient and at the same time a thorough cleaning of a tunnel.

The invention claimed is:

1. Cleaning device for the dry cleaning of a tunnel, comprising a) a feeding device for feeding a flow of air to a surface being cleaned, wherein the feeding device has an exit opening, through which the flow of air emerges from the feeding device b) a removal device comprising several removal pipes arranged in a row alongside each other, each removal pipe having a free end with an opening for suctioning away dirt or trash from the surface with the opening of the free end in a first direction, wherein the feeding device is arranged such that the flow of air from the exit opening emerges from the feeding device in a second direction toward the opening of the free end of the removal pipe and impinges on the surface, the first direction being oriented at an angle between 45° and 80° to the second direction and wherein each of the removal pipes comprises an end element at an end of the removal pipe, the end element being directed toward the surface being cleaned, wherein an end element of a first of the removal pipes is movable relative to an end element of a second of the removal pipes.

2. Cleaning device according to claim 1, wherein the removal pipe comprises an end element at an end of the removal pipe directed toward the surface being cleaned, wherein the end element is movable relative to the feeding device.

3. Cleaning device according to claim 1, wherein the removal pipe has a flexible region after the end element in the suction direction and then a rigid region, so that the end element can swivel relative to the rigid region of the removal pipe.

4. Cleaning device according to claim 1, wherein the removal pipe has an inner diameter between 5 and 30 cm.

5. Cleaning device according to claim 4, wherein the removal pipe has an inner diameter between 8 and 20 cm.

6. Cleaning device according to claim 1, wherein the feeding device comprises several feed pipes for the feeding of the flow of air.

7. Cleaning device according to claim 1, wherein a brush is arranged in an end region of the removal pipe, for brushing off the surface being cleaned.

8. Cleaning module comprising a cleaning device according to claim 1, a compressed air source for generating an air pressure in the feeding device, a suction device for generating a partial vacuum in the removal device, and a container to hold the suctioned dirt and trash.

9. Cleaning module according to claim 8, wherein the volume flow for the feeding device generated by the compressed air source is between 1000 $m^3$/h and 4000 $m^3$/h.

10. Cleaning module according to claim 8, wherein the suction power generated for the removal device by the suction device is between 20,000 $m^3$/h and 60,000 $m^3$/h.

11. Cleaning module according to claim 8, comprising a chamber formed by four side walls and a cover, wherein at least one lower end region of the removal device and a lower end region of the feeding device are enclosed by the chamber, wherein a pressure can be generated in the chamber which is less than atmospheric pressure.

12. Cleaning module according to claim 8, comprising a detection device for detecting obstacles, an evaluation unit and a drive for adjusting the removal device in the vertical direction relative to the feeding device, wherein the detection device is designed to send signals to the evaluation unit and wherein the evaluation unit is designed to control the drive in dependence on the signals.

13. Rail vehicle comprising a cleaning module according to claim 8.

14. Rail vehicle according to claim 13, wherein the rail vehicle comprises at least four wheels each with a running surface, wherein the free end of the removal pipe can be lowered past the lowermost point on the running surface of a wheel by at least 15 cm, preferably at least 20 cm, in the vertical direction.

15. Cleaning device according to claim 1, wherein the several removal pipes are arranged in a row alongside each other.

16. Cleaning device according to claim 1, comprising at least 10 removal pipes per meter.

17. Cleaning device according to claim 16, comprising at least 20 removal pipes per meter.

18. Method for the dry cleaning of a tunnel with a cleaning device according to claim 1, involving the steps of positioning of the cleaning device relative to the surface being cleaned, moving the cleaning device relative to the surface along a longitudinal axis of the tunnel, during the movement, feeding a flow of air onto the surface, so that dirt or trash is loosened from the surface, and during the movement, removing the loosened dirt or trash from the surface with a removal device.

19. Method according to claim 18, wherein at least one removal pipe of several removal pipes of the removal device is moved during the cleaning of the tunnel in a direction relative to the surface and relative to another one of the removal pipes which is different from the longitudinal axis of the tunnel.

* * * * *